US006405695B2

(12) United States Patent
Mizutani et al.

(10) Patent No.: US 6,405,695 B2
(45) Date of Patent: Jun. 18, 2002

(54) VALVE TIMING ADJUSTER FOR INTERNAL COMBUSTION ENGINE

(75) Inventors: Shuji Mizutani, Chita-gun; Yasushi Morii, Nagoya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/736,363

(22) Filed: Dec. 15, 2000

(30) Foreign Application Priority Data

Dec. 15, 1999 (JP) ..... 11-355643

(51) Int. Cl.[7] ..... F01L 1/34

(52) U.S. Cl. ..... 123/90.17; 123/90.65; 74/568 R; 464/2

(58) Field of Search ..... 123/90.15, 90.17, 123/90.31, 90.65; 74/568 R; 464/1, 2, 160

(56) References Cited

U.S. PATENT DOCUMENTS 5,181,484 A * 1/1993 Kan et al. ..... 123/90.17
5,704,316 A * 1/1998 Fujimoto et al. ..... 123/90.17
5,775,279 A 7/1998 Ogawa et al. ..... 123/90.17
5,813,378 A * 9/1998 Sato ..... 123/90.17
5,870,983 A * 2/1999 Sato et al. ..... 123/90.17
6,035,819 A * 3/2000 Nakayoshi et al. ..... 123/90.17
6,039,016 A 3/2000 Noguchi ..... 123/90.17
6,135,077 A * 10/2000 Moriya et al. ..... 123/90.17
6,155,219 A * 12/2000 Fukuhara et al. ..... 123/90.17

FOREIGN PATENT DOCUMENTS

JP 2000-97006 4/2000

* cited by examiner

*Primary Examiner*—Weilun Lo
(74) *Attorney, Agent, or Firm*—Nixon & Vanderhye PC

(57) ABSTRACT

A torsion coil spring is installed in a circle groove of a chain sprocket. Both ends of the coil spring are bent in a radially outward direction. The first bent end is fit to a fixed pin protruding from the chain sprocket, and the second bent end is fit to a pin protruding from a vane rotor. The coil spring urges the vane rotor such that the vane rotor advances with respect to the chain sprocket. That is, the coil spring urges the vane rotor such that a camshaft advances with respect to an engine crankshaft.

9 Claims, 6 Drawing Sheets

VALVE TIMING ADJUSTER FOR INTERNAL COMBUSTION ENGINE

CROSS REFERENCE TO RELATED APPLICATION

This application is based on and incorporates herein by reference Japanese Patent Application No. Hei. 11-355643 filed on Dec. 15, 1999.

BACKGROUND OF THE INVENTION

1. Field of the Invention

The present invention relates to a valve timing adjuster used for controlling a valve timing of an intake valve or an exhaust valve of an internal combustion engine.

2. Description of Related Art

A vane type valve timing adjuster is used for controlling a valve timing of an intake valve or an exhaust valve of an engine.

The vane type valve timing adjuster includes a vane rotating with a camshaft. The vane is provided within a housing rotating with a timing pulley. A fluid pressure chamber is formed between the housing and the vane, and fluid pressure therein acts on the camshaft and the timing pulley to rotate relatively to each other. In this way, the valve timing adjuster controls the valve timing of the intake valve or the exhaust valve based on an engine driving condition.

JP-A-10-252420 and JP-A-11-132014 disclose a valve timing adjuster including a coil spring to urge a camshaft in an advance direction with respect to a housing. In JP-A-10-252420 and JP-A=11-132014, both ends of the coil spring are inserted into holes within a housing side member and a camshaft side member, respectively. The both ends of the coil spring are axially bent to fix to the housing side member and the camshaft side member.

The coil spring should be bent by particular bent radius over a predetermined radius for attaining a sufficient strength. Thus, when the coil spring is axially bent, there is a need to provide an axially large space for preventing the bent portion of the coil spring from contacting with the housing side member and the camshaft side member, thereby enlarging the entire valve timing adjuster in the axial direction.

SUMMARY OF THE INVENTION

An object of the present invention is to reduce a size of a vane type valve timing adjuster containing a coil spring.

According to a first aspect of the present invention, a coil spring urges a vane so that a following shaft advances or retards with respect to a driving shaft. The coil spring includes a first end fit to a housing, and a second end fit to the vane. At least one of the f first and second ends is radially bent for positioning the coil spring. Thus, the axial length of the housing containing the coil spring is shortened, thereby compacting the entire valve timing adjuster.

According to a second aspect of the present invention, the radially bent end of the coil spring is fit to a fixed member axially protruding from one of the housing and the vane. Thus, the coil spring easily positioned.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

First Embodiment

Figure 1:
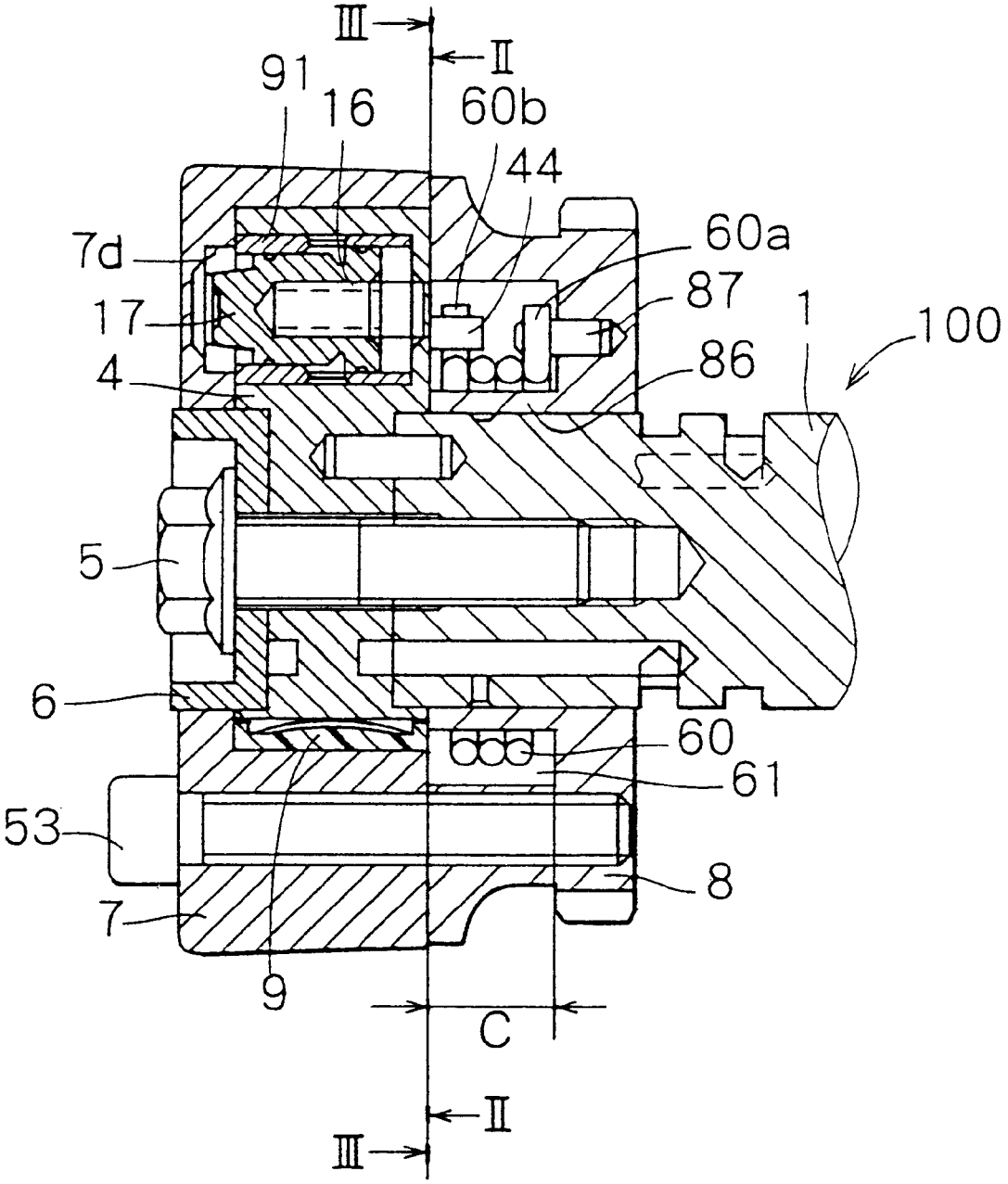
FIG. 1 is a cross sectional view showing a valve timing adjuster (first embodiment)
Figure 2:
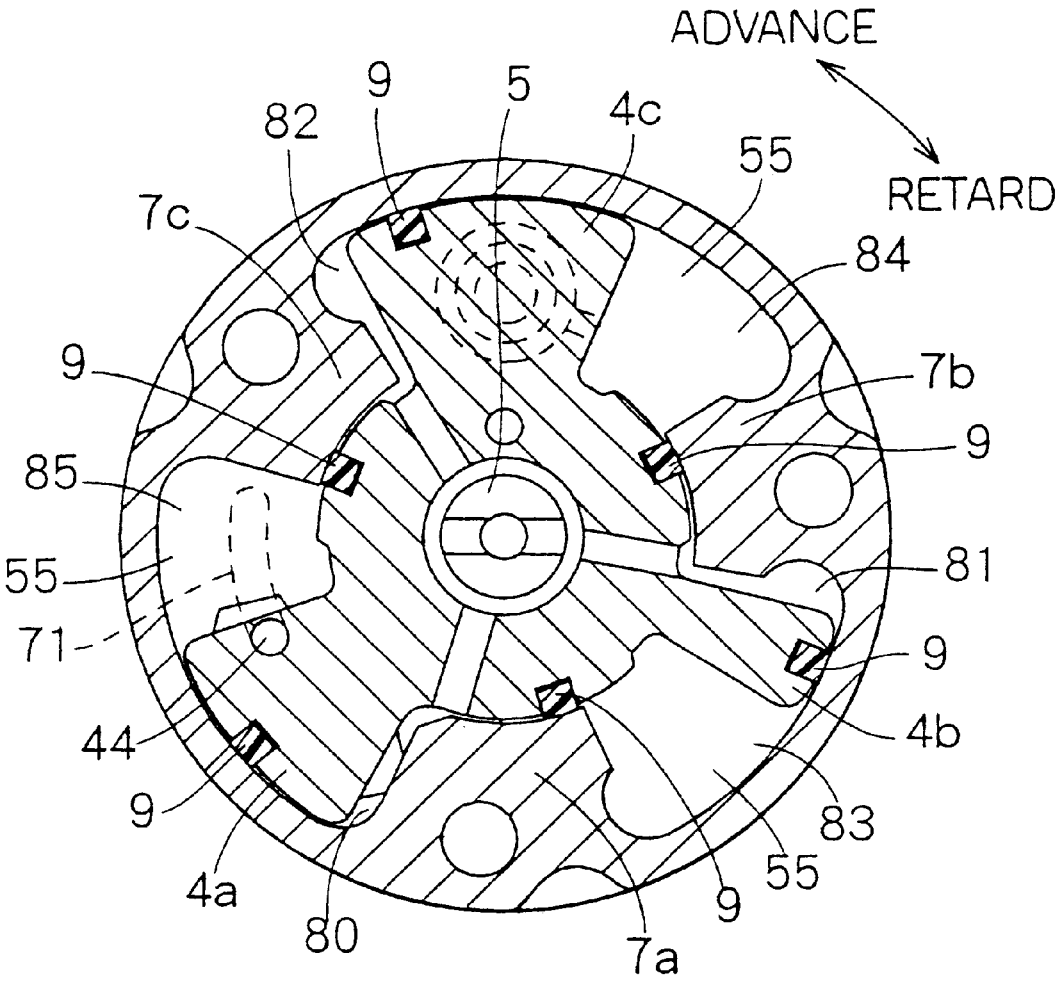
FIG. 2 is a cross sectional view taken along line II—II in FIG. 1 (first embodiment)
Figure 3:
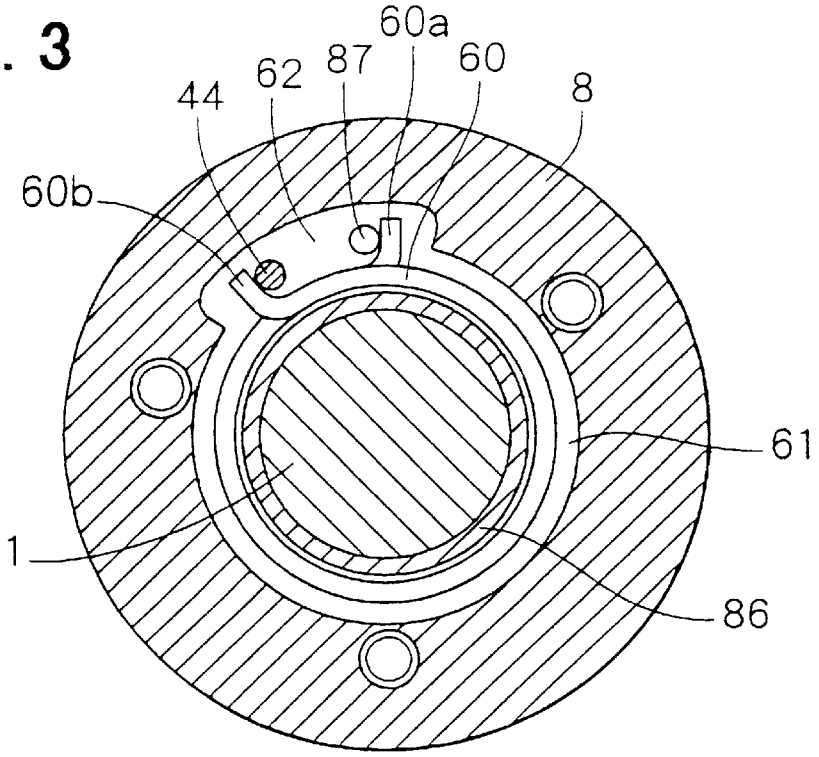
FIG. 3 is a cross sectional view taken along line III—III in FIG. 1 (first embodiment, first example)

FIGS. 1–3 show a valve timing adjuster 100 used for an engine. The valve timing adjuster 100 of the present embodiment is controlled by oil pressure, and controls the valve timing of an intake valve or an exhaust valve.

As shown in FIG. 1, the valve timing adjuster 100 includes a chain sprocket 8. The chain sprocket 8 connects with a crankshaft of the engine (not illustrated) through a chain (not illustrated). A driving force of the engine is transmitted to the chain sprocket 8, and the chain sprocket 8 rotates while synchronizing with the crankshaft. The driving force is transmitted from the chain sprocket 8 to a camshaft 1, and the camshaft 1 opens and closes the intake valve or the exhaust valve (not illustrated). A cylinder head supports the camshaft 1, and the camshaft 1 is capable of rotating with respect to the chain sprocket 8 by a predetermined phase difference. The chain sprocket 8 and the camshaft 1 rotate in a clockwise direction viewing from left side in FIG. 1. Hereinafter, the rotation direction is defined as an advance direction.

A shoe-housing 7 is connected to the chain sprocket 8 by a bolt 53, and the shoe-housing 7 and the chain sprocket 8 form a housing of the valve timing adjuster 100. As shown in FIG. 2, the shoe-housing 7 includes trapezoid shoes 7*a*, 7*b*, 7*c* circumferentially arranged at predetermined intervals. Fan-shaped spaces 55 are provided between each of shoes 7*a*, 7*b* and 7*c*, for containing vanes 4*a*, 4*b* and 4*c*. Inner periphery surfaces of the shoes 7*a*, 7*b* and 7*c* are formed in an arc in cross section.

A vane rotor 4 includes the vanes 4*a*, 4*b* and 4*c* in the circumferential direction, and the vanes 4*a*, 4*b* and 4*c* are arranged at predetermined intervals. The vanes 4*a*, 4*b* and 4*c* are rotatably installed in the spaces 55. In FIG. 2, arrows denote retard and advance directions of the vane rotor 4 with respect to the shoe-housing 7. In FIG. 2, each vane 4*a*, 4*b* and 4*c* is positioned at advance end of each space 55 in the circumferential direction. That is, the vane rotor 4 is positioned at the most advanced position with respect to the shoe-housing 7. The most advanced position is defined such that the advance side surface of the vane 4*a* is stopped by the retard side surface of the shoe 7*a*. As shown in FIG. 1, the vane rotor 4 is integrally connected to the camshaft 1 by a bolt 5.

A bushing 6 is press inserted into the vane rotor 4, and works as a driven side rotary member in the present invention. The camshaft 1 and the bushing 6 are fit to the shoe-housing 7 rotatably with respect to the shoe-housing 7. The camshaft 1 is rotatably fit to a bearing 86 of the chain sprocket 8. Therefore, the camshaft 1 and the vane rotor 4 are capable of concentrically rotating with respect to the chain sprocket 8 and the shoe-housing 7.

A seal member 9 is fit to the outer wall of the vane rotor 4. A slight clearance is provided between the outer wall of the vane rotor 4 and the inner wall of the shoe-housing 7. The seal member 9 prevents mechanic oil from leaking into an oil pressure chamber through the clearance.

As shown in FIG. 2, a retard oil pressure chamber 80 is formed between the shoe 7 and the vane 4. Similarly, a retard oil pressure chamber 81 is formed between the shoe 7*b* and the vane 4*b*, and a retard oil pressure chamber 82 is formed between the shoe 7*c* and the vane 4*c*. An advance oil pressure chamber 83 is formed between the shoe 7*a* and the vane 4*b*. Similarly, an advance oil pressure chamber 84 is formed between the shoe 7*b* and the vane 4*c*, and an advance oil pressure chamber 85 is formed between the shoe 7*c* and the vane 4*a*. An ECU controls a switching valve to switch connection states among oil passages communicating with the retard oil pressure chambers 80, 81, 82, oil passages communicating with the retard oil pressure chambers 83, 84, 85, an oil pressure pump and a drain. Thus, the vane rotor 4 is controlled to rotate with respect to the shoe-housing 7 within a predetermined angle range in the advance and retard directions.

A torsion coil spring 60 is inserted into a circle groove 61 formed within the chain sprocket 8. As shown in FIG. 3, both ends of the coil spring 60 are bent radially outwardly. First bent end 60*a* is fit to a pin 87 axially protruding from the chain sprocket 8. Second bent end 60*b* is fit to a pin 44 axially protruding from the vane rotor 4. The coil spring 60 urges the vane rotor 4 to advance the vane rotor 4 with respect to the chain sprocket 8. That is, the coil spring 60 urges the vane rotor 4 to advance the camshaft 1 with respect to the engine crankshaft. FIG. 3 shows a state that the vane rotor 4 is positioned at retard side with respect to the chain sprocket 8. Since both ends of the coil spring 60 are bent radially, axial length (denoted by C in FIG. 1) of the circle groove 61 containing the coil spring 60 can be smaller than that in both spring ends are axially bent, thereby compacting an entire valve timing adjuster 100.

Figure 4:
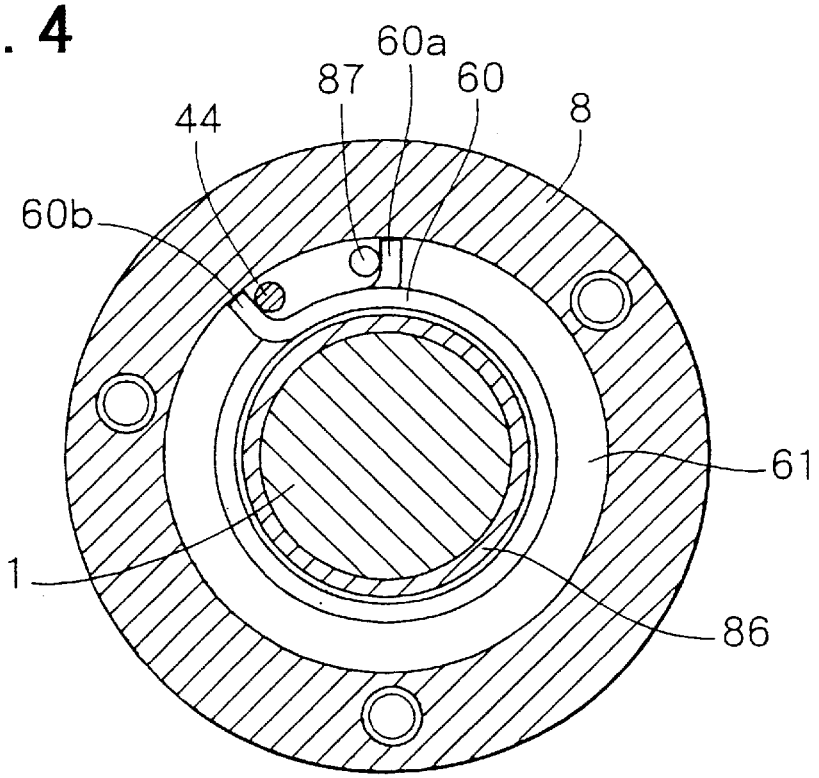
FIG. 4 is a cross sectional view taken along line III—III in FIG. 1 (first embodiment, second example)

The circle groove 61 includes a radially concave portion 62 at an inner periphery thereof. The concave portion 62 is formed within a range where the second bent portion 60*b* and the pin 44 rotate when the vane rotor 4 rotates with respect to the chain sprocket 8 for preventing the pin 44 from contacting with the chain sprocket 8. Alternatively, as shown in FIG. 4, outer radius of the entire circle groove 61 may be enlarged for preventing the pin 44 from contacting with the chain sprocket 8.

A rear plate is provided between the shoe-housing 7 and the chain sprocket 8 to prevent the oil from leaking therethrough. The rear plate includes an arc slot 71 through which the pin 44 passes when the vane rotor 4 rotates with respect to the chain sprocket 8.

As shown in FIG. 1, a guide ring 91 is press inserted into the inner wall of the vane 4*c*, and a stopper piston 17 is inserted into the guide ring 91. A spring 16 urges the stopper piston 17 toward the shoe-housing 7. When the vane rotor 4 is placed at the most advanced position, the stopper spring 7 is capable of fitting to a stopper hole 7*d* within the shoe-housing 7. When the stopper spring 7 is fit to the stopper hole 7*d* and contacts the stopper hole 7*d* in the circumferential direction, the vane rotor 4 does not rotate with respect to the shoe-housing 7. A restricting means in the present invention includes the stopper piston 7, the stopper hole 7*d*, and the spring 16. During an advance control, when working oil of which the pressure is over a predetermined pressure is supplied into the advance oil pressure chamber 84, the working oil pressure allows the stopper piston 7 to be released from the stopper hole 7*d* against the force of the spring 16. During a retard control, when working oil of which the pressure is over a predetermined pressure is supplied into the retard oil pressure chamber 82, the working oil pressure allows the stopper piston 7 to be released from the stopper hole 7*d* against the force of the spring 16.

An operation of the valve timing adjuster 100 used for the exhaust valve will be explained.

When the engine normally stops, the retard oil pressure chambers 80, 81, 82 are exposed to the drain side, and the ECU controls the switching valve to keep the working oil pressure acting on the advance oil pressure chambers 83, 84, 85. Then, the vane rotor 4 rotates with respect to the shoe-housing 7, and to the most advanced position. Here, since the restricting means connects the vane rotor 4 to the shoe-housing 7, the camshaft 1 is held at the most advanced position.

When the engine starts a normal driving, working oil of which the pressure is over a predetermined pressure is into each oil passage and into each oil pressure chamber, so that the restricting means releases the vane rotor 4 from the shoe-housing 7. The vane rotor 4 rotates with respect to the shoe-housing 7 due to the working oil pressure acting on the retard oil pressure chambers 80, 81, 82 and the advance oil pressure chambers 83, 84, 85 and the force of the coil spring 60. In this way, the phase difference of the camshaft 1 relative to the chain sprocket 8 is adjusted.

When the engine abnormally stops, oil pressure control is shut off and the camshaft 1 does not stop at the most advanced position with respect to the crankshaft. However, even in such a case, the vane rotor 4 rotates in advance due to the force of the coil spring 60 and a negative driving torque acting on the camshaft 1, and the restricting means maintains the vane rotor 4 at the most advanced position. Thus, overlap period of the exhaust valve and the intake valve does not become too long, so that the engine can start normally.

Second Embodiment

Figure 5:
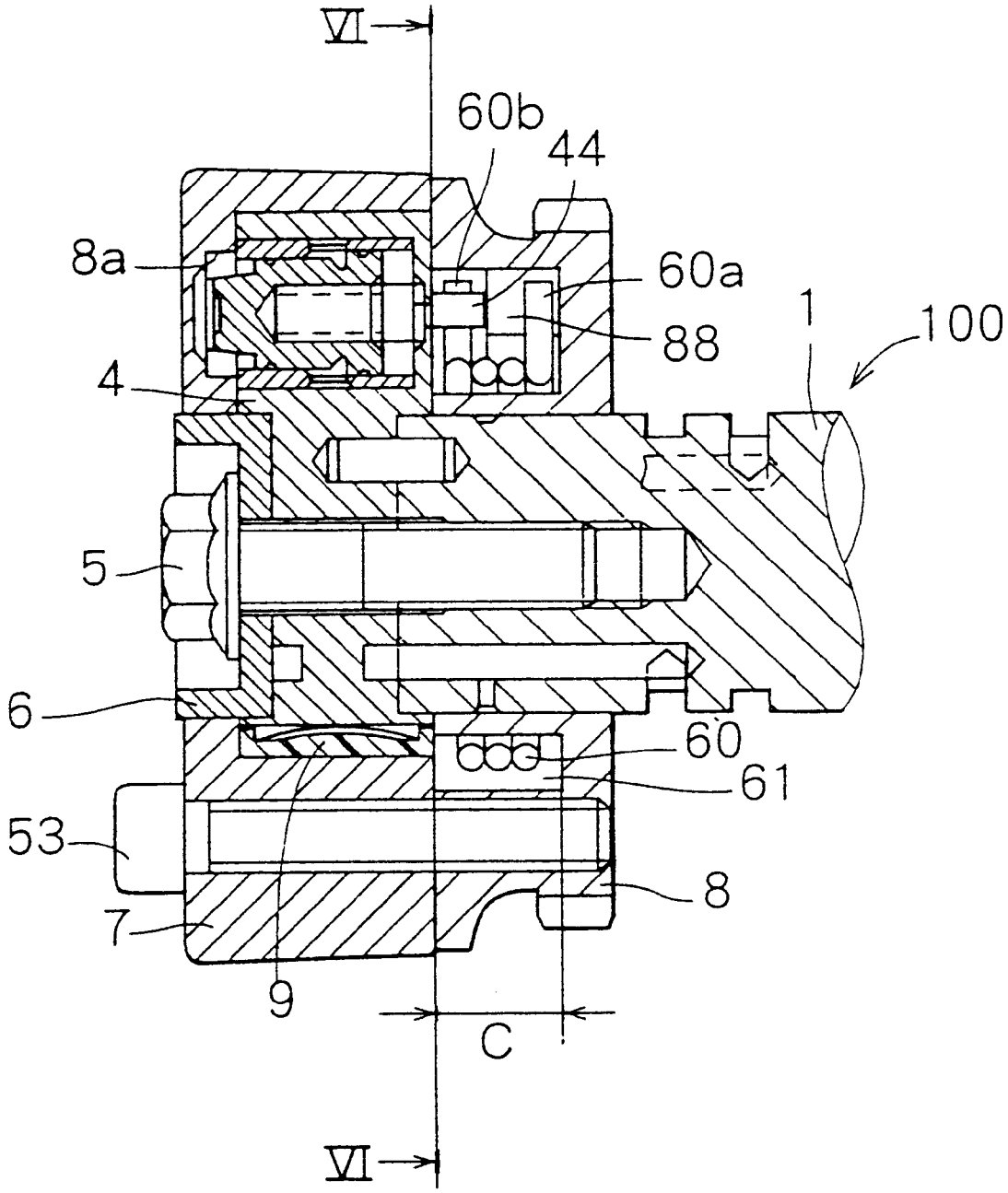
FIG. 5 is a cross sectional view showing a valve timing adjuster (second embodiment)
Figure 6:
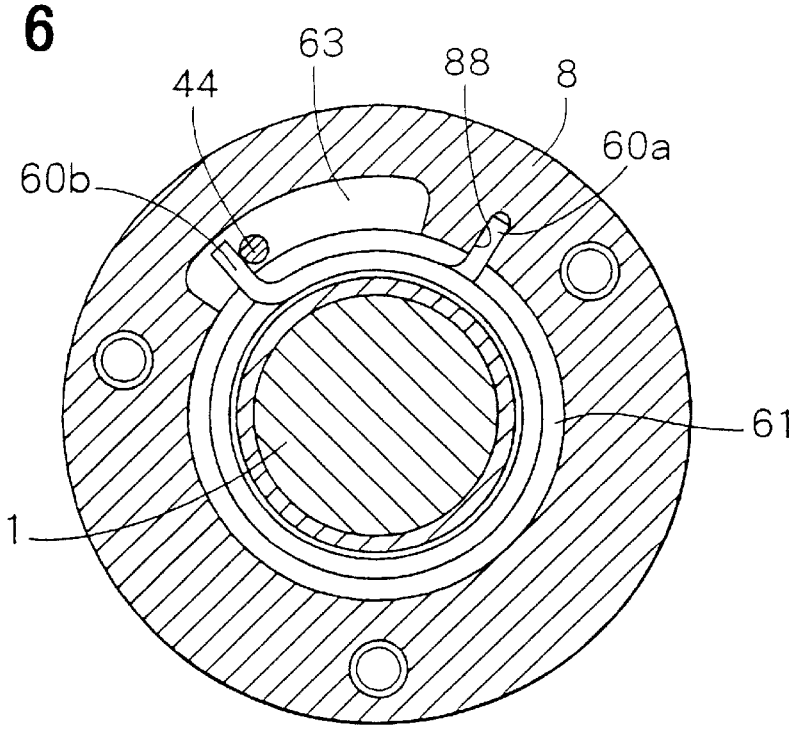
FIG. 6 is a cross sectional view taken along line VI—VI in FIG. 5 (second embodiment)

In the second embodiment, as shown in FIGS. 5 and 6, the chain sprocket 8 includes a concave portion 63 outside the circle groove 61, where the second bent end 60*b* of the coil spring 60 and the pin 44 protruding from the vane rotor 4 are provided. The second bent end 60*b* and the pin 44 rotate with respect to the chain sprocket 8 within a predetermined angle range. The axial length of the concave portion 63 is smaller than that of the circle groove 61, and is set such that the bent end 60*b* and the pin 44 do not interfere with the chain sprocket 8. Thus, when the concave portion 63 is cut-formed, manufacturing procedures are reduced.

The first bent end 60*a* of the coil spring 60 is inserted into a fixed groove 88 of the chain sprocket 8, for being positioned. The axial length of the fixed groove 88 is larger than that of the concave portion 63.

The coil spring 60 urges the vane rotor 4 toward the advance position (in the clockwise direction) from the retard position shown in FIG. 6, as in the first embodiment.

Third Embodiment

Figure 7:
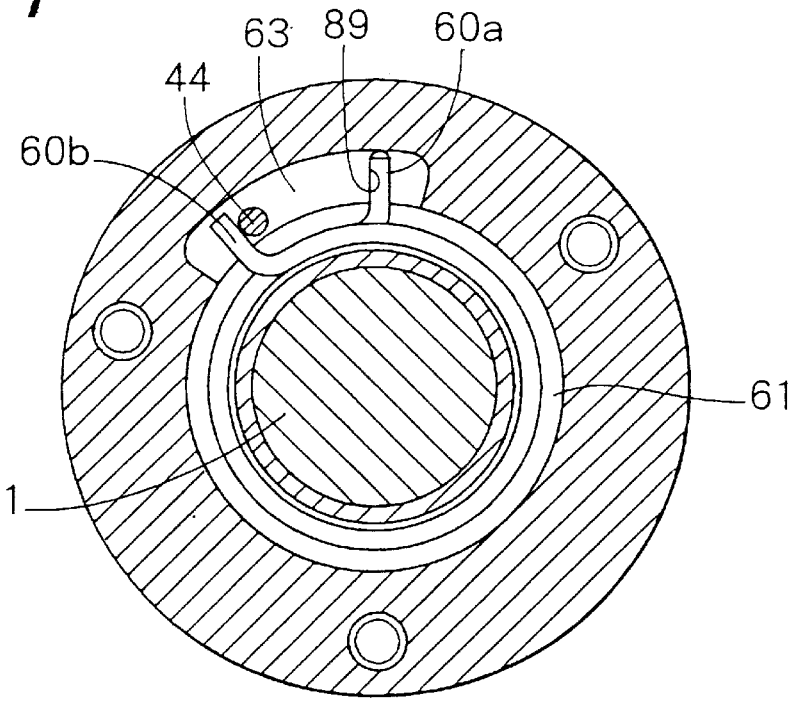
FIG. 7 is a cross sectional view taken along line VI—VI in FIG. 5 (third embodiment)

FIG. 7 is a cross sectional view showing the third embodiment, corresponding to FIG. 6 in the second embodiment.

As shown in FIG. 7, in the third embodiment, a fixed groove 89 is formed within an angle range of the concave portion 63. The fixed grove 89 positions the first bent end 60*a* of the coil spring 60. In general, for attaining a sufficient strength of the chain sprocket 8, axial thickness of portions, where a concave portion 63 and a fixed groove 89 are formed, need to be increased. However, according to the third embodiment, there is no need to increase the axial thickness of the chain sprocket 8 relatively to the first and second embodiment, thereby lightening the entire valve timing adjuster 100.

Fourth Embodiment

Figure 8:
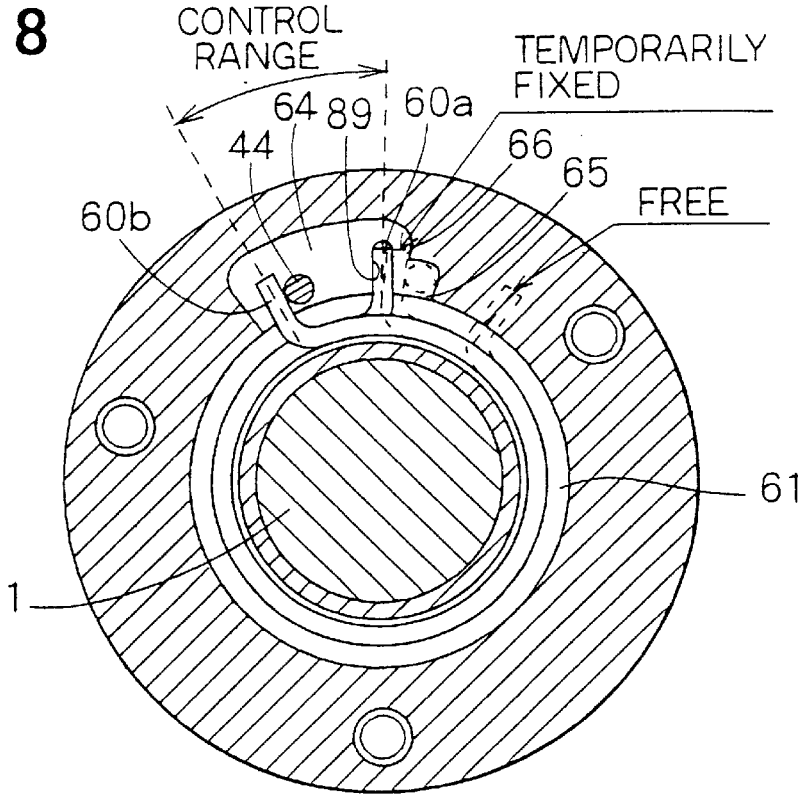
FIG. 8 is a cross sectional view taken along line VI—VI in FIG. 5 (fourth embodiment, first example)

FIG. 8 is a cross sectional view showing the fourth embodiment, corresponding to FIG. 6 in the second embodiment.

As shown in FIG. 8, in the fourth embodiment, a second concave portion 65 is provided next to a first concave portion 64. The second bent end 60*b* and the pin 44 are contained in the first concave portion 64, and rotate within a predetermined control range. The second concave portion 65 is radially smaller than the first concave portion 64, so that the second bent end 60*b* can contact a stage 66 between the first concave portion 64 and the second concave portion 65.

A procedure of installing the coil spring 60 into the valve timing adjuster 100 will be explained.

When only the first bent end 60*a* is positioned by the fixed groove 89, the second bent end 60*b* is freely positioned as shown in FIG. 8. In this state, the second bent end 60*b* is outside the range of the first concave portion 64, so that the vane rotor 4 cannot face to the chain sprocket 8.

Next, the second bent end 60*b* is temporally fixed to contact the stage 66 against the force of the spring 60 as shown in FIG. 8. Here, since the second concave portion 65 is provided next to the first concave portion 64, the vane rotor 4 is assembled such that the vane rotor 4 faces to the chain sprocket 8 and the pin 44 is fit to the advance side surface of the second bent end 60*b*.

The vane rotor 4 is rotated in the retard direction (anti-clockwise direction in FIG. 8), so that the second bent end 60*b* also rotates in the retard direction. In this way, both ends of the coil spring 60 are positioned at predetermined positions thereof. Since the vane rotor 4 faces to the chain sprocket 8 while the coil spring 60 is temporally fixed, the coil spring 60 is easily installed. Further, since a concave portion area is reduced, a backside area of the concave portion, of which thickness should be increased, is reduced, thereby lightening the entire valve timing adjuster 100.

Figure 9:
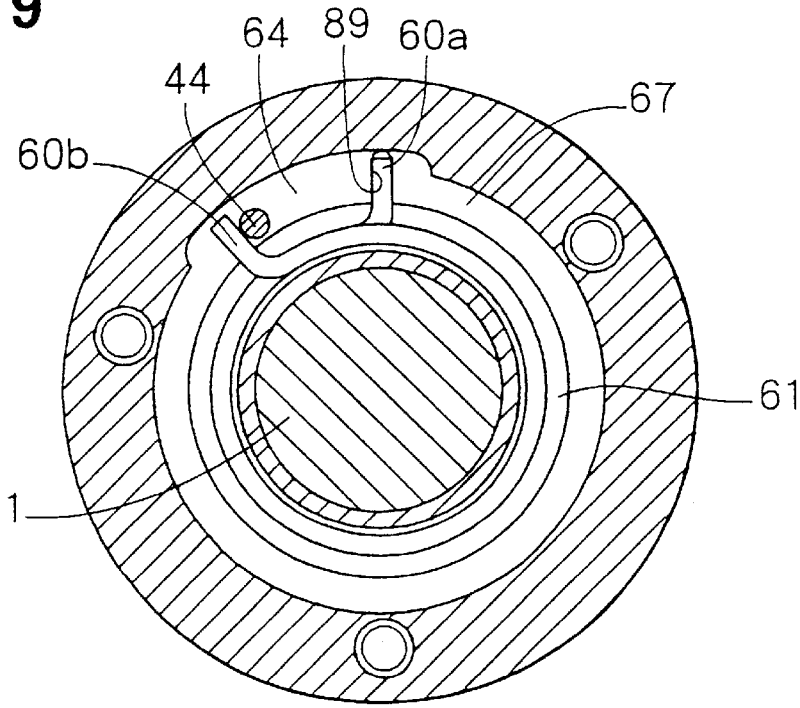
FIG. 9 is a cross sectional view taken along line VI—VI in FIG. 5 (fourth embodiment, second example).

Here, as shown in FIG. 9, a second groove 67 may be entirely formed along the inner periphery of the circle groove 61. In this case, when the pin 44 is fit to the second concave portion 67, there is no need to position the pin 44. Thus, the coil spring 60 is more easily installed into the valve timing adjuster 100.

Modifications

According to the above-descried embodiments, the vane rotor 4 includes three vanes. Alternatively, the vane rotor may have one or more vanes.

According to the above-described embodiments, the rotation driving force is transmitted from the crankshaft to the camshaft through the chain sprocket. Alternatively, the rotation driving force may be transmitted through a timing pulley, a timing gear or the like. Further, a vane rotor may receive a driving force from the crankshaft, and a camshaft and a shoe housing may integrally rotate.

What is claimed is:

1. A valve timing adjuster for controlling a valve of an internal combustion engine, comprising:

a driving force transmission for transmitting a driving force from a driving shaft of said engine to a following shaft opening and closing said valve;

a housing rotating with one of said driving shaft and said following shaft, said housing defining an advance chamber and a retard chamber;

a vane rotating with the other of said driving shaft and said following shaft, said vane provided in said housing to rotate with respect to said housing within a predetermined angle range;

a fluid pressure supply means for supplying an operating fluid into said advance chamber to allow one of said housing and said vane to rotate in an advance direction relatively with respect to the other of said housing and said vane, and into said vane to rotate in a retard direction relatively with respect to the other of said housing and said vane; and a coil spring urging said vane so that said following shaft advances or retards with respect to said driving shaft, wherein first and second ends of said coil spring are fit to said housing and said vane, respectively, and at least the second end is radially bent for positioning said coil spring;

wherein the radially bent second end is fit to a fixed member axially protruding form said vane; and said housing includes a concave portion that is concaved in an area radially outside of the coil spring to accommodate the fixed member and the second end of the coil, the concave portion extending a predetermined angle range in which the fixed member and the second end of the coil rotate relative to the housing.

2. A valve timing adjuster according to claim 1, wherein the fixed member is a non-unitary member to the vane but attached thereto.

3. A valve timing adjuster according to claim 1, wherein the first and second ends of the coil spring are both radially bent in an outward direction so that both the first and second ends are radially outside of the coil spring.

4. A valve timing adjuster according to claim 3, wherein the first end of said coil spring is positioned within an angle range of said concave portion.

5. A valve timing adjuster according to claim 4, wherein, said concave portion includes a first concave portion where the second bent end of said coil spring is contained to rotate therein and a second concave portion arranged next to said first concave portion, and said second concave portion is radially smaller than the second bent end of said coil spring.

6. A valve timing adjuster for controlling a valve of an internal combustion engine, comprising:

a driving force transmission for transmitting a driving force from a driving shaft of said engine to a following shaft opening and closing said valve;

a housing rotating with one of said driving shaft and said following shaft, said housing defining an advance chamber and a retard chamber;

a vane rotating with the other of said driving shaft and said following shaft, said vane provided in said housing to rotate with respect to said housing within a predetermined angle range;

a fluid pressure supply means for supplying an operating fluid into said advance chamber to allow one of said housing and said vane to rotate in an advance direction relatively with respect to the other of said housing and said vane, and into said retard chamber to allow one of said housing and said vane to rotate in a retard direction relatively with respect to the other of said housing and said vane; and a coil spring urging said vane so that said following shaft advances or retards with respect to said driving shaft, wherein:

first and second ends of said coil spring are fit to said housing and said vane, respectively;

at least one of said first and second ends is radially bent for positioning said coil spring;

the radially bent end is fit to a fixed member axially protruding from one of said housing and said vane;

said housing includes a concave portion where said fixed member protruding from said vane and the second end of said coil spring are contained to rotate relatively to each other within a predetermined angle range; and the first end of said coil spring is positioned within an angle range of said concave portion.

7. A valve timing adjuster according to claim 6, wherein, said concave portion includes a first concave portion where the second bent end of said coil spring is contained to rotate therein and a second concave portion arranged next to said first concave portion, and said second concave portion is radially smaller than the second bent end of said coil spring.

8. A valve timing adjuster of an internal combustion engine disposed between a driving shaft and a following shaft of the engine, comprising:

a housing rotating with one of the driving shaft and the following shaft, the housing;

a vane rotating with the other of the driving shaft and the following shaft, the vane being provided in said housing to define an advance chamber and a retard chamber within the housing, the vane being capable of rotating with respect to the housing within a predetermined angle range;

a coil spring having a first end and a second end connected to the housing and the vane respectively, the coil spring being loaded to rotate the vane in a predetermined direction relative to the housing, at least one of the first and second ends is bent radially outside of the coil spring as a bent end;

a member defining a cylinderical container of the coil spring and a concave portion radially concaved from the cylinderical container; and a fixed member axially protruding a predetermined height from a wall of the container and fitted to the bent end of the coil spring;

wherein the bent end extends axially into the concave portion so that the bent end is able to rest on a circumferential wall of the concave portion, and the fixing member is located radially inside of the concave portion so that the fixing member is able to fit to the bent end rested on a circumferential wall of the concave portion when the housing and the vane are relatively rotated in a counter direction of the predetermined direction urged by the coil spring.

9. A valve timing adjuster according to claim 8, wherein the concave portion has a first concave portion which has a radial depth enough to accommodate the bent end, and a second concave portion which is arranged next to the first concave portion to provide the circumferential wall on which the bent end rests and has a radial depth smaller than the first concave portion but enough to accommodate the fixed member.

* * * * *